US008960944B2

(12) United States Patent
Foo

(10) Patent No.: US 8,960,944 B2
(45) Date of Patent: Feb. 24, 2015

(54) SEAT CUP HOLDER WITH RIM NIGHT LIGHT ARRANGEMENT

(71) Applicant: Hung Yuan Foo, Cerritors, CA (US)

(72) Inventor: Hung Yuan Foo, Cerritors, CA (US)

( * ) Notice: Subject to any disclaimer, the term of this patent is extended or adjusted under 35 U.S.C. 154(b) by 295 days.

(21) Appl. No.: 13/573,885

(22) Filed: Oct. 13, 2012

(65) Prior Publication Data

US 2014/0104817 A1 Apr. 17, 2014

(51) Int. Cl.
*F21V 33/00* (2006.01)

(52) U.S. Cl.
USPC ..... 362/154; 362/488

(58) Field of Classification Search
None
See application file for complete search history.

(56) References Cited

U.S. PATENT DOCUMENTS

| | | | | |
|---|---|---|---|---|
| 8,485,680 | B2 * | 7/2013 | Anderson et al. | 362/101 |
| 2007/0247836 | A1 * | 10/2007 | Seidl et al. | 362/154 |
| 2008/0266853 | A1 * | 10/2008 | Goto | 362/240 |
| 2010/0295340 | A1 * | 11/2010 | Stangl et al. | 297/188.01 |

* cited by examiner

*Primary Examiner* — David V Bruce
(74) *Attorney, Agent, or Firm* — Raymond Y. Chan; David and Raymond Patent Firm

(57) ABSTRACT

A seat cup holder includes a main body and a rim night light arrangement. The main body includes a holder element defining a receiving cavity formed within the holder element. The holding rim is peripherally provided at a top edge portion of the holder element, and contains a receiving slot formed along the holding rim. The rim night light arrangement includes at least one illuminator supported in the receiving slot of the holding rim, and a rim reflector mounted on the holding rim for peripherally enclosing the receiving slot for reflecting illumination coming from the illuminator, wherein when the illuminator is activated to generate illumination, the illumination is arranged to partially propagate toward the holder element, and partially propagate toward the rim reflector which reflects the illumination to surrounding space of the main body so as to produce a predetermined lighting effect of the seat cup holder.

32 Claims, 7 Drawing Sheets

SEAT CUP HOLDER WITH RIM NIGHT LIGHT ARRANGEMENT

BACKGROUND OF THE PRESENT INVENTION

1. Field of Invention

The present invention relates to a cup holder, and more particularly to a seat cup holder with rim a night light arrangement which is capable of providing illumination for the seat cup holder so as to produce different lighting effects and allow the seat cup holder to form a night light in appropriate circumstances.

2. Description of Related Arts

A conventional cup holder usually comprises a main body having a receiving cavity formed therein, wherein a user is able to dispose a cup of a predetermined size in the receiving cavity for restraining a movement of the cup. The cup holder may be used in a variety of circumstances. For example, the cup holder may be used in a vehicle for ensuring that the cup is well supported without excessive movement when the vehicle is operating. The cup holder may even be utilized at home for insulation or decoration purposes.

A major disadvantage of the above-mentioned conventional cup holder is that it is not equipped with illuminators for providing illumination. Thus, when a user cannot put his cup into the conventional cup holder with a view that it will be easier for him to locate the cup when light is not adequate. This is especially true when a user wishes to locate his cup at night. In other words, there is no need for the user to dispose the cup into the cup holder because the cup holder cannot generate illumination for allowing him to quickly and accurately locate the cup when the environment is dark.

SUMMARY OF THE PRESENT INVENTION

The invention is advantageous in that it provides to a seat cup holder with a rim night light arrangement which is capable of providing illumination for the seat cup holder so as to produce different lighting effects and allow the seat cup holder to form a night light in appropriate circumstances.

Another advantage of the invention is to provide a seat cup holder which comprises a main body and a rim night light arrangement provided thereon for generating a predetermined amount of dim light. Thus, the present invention may be utilized by a user to act as a night light and for identifying the location of the cup disposing on the seat cup holder.

Another advantage of the invention is to provide a seat cup holder comprising a rim night light arrangement which utilizes rechargeable batteries as power source so that the present invention can be used in a wide variety of circumstances.

Another advantage of the invention is to provide a seat cup holder comprising a rim night light arrangement which does not involve complicated or expensive mechanical and electrical components. Therefore, the manufacturing cost and the ultimate selling price of the present invention can be kept to a minimum.

Additional advantages and features of the invention will become apparent from the description which follows, and may be realized by means of the instrumentalities and combinations particular point out in the appended claims.

According to the present invention, the foregoing and other objects and advantages are attained by providing a seat cup holder, comprising:

a main body, which comprises:

a holder element having a predetermined height and cross section shape, and defines a receiving cavity formed within the holder element; and a holding rim which is peripherally provided at a top edge portion of the holder element, and contains a receiving slot formed along the holding rim; and a rim night light arrangement, which comprises:

at least one illuminator supported in the receiving slot of the holding rim for providing illumination; and a rim reflector mounted on the holding rim for peripherally enclosing the receiving slot for reflecting illumination coming from the illuminator, wherein when the illuminator is activated to generate illumination, the illumination is arranged to partially propagate toward the holder element, and partially propagate toward the rim reflector which reflects the illumination to surrounding space of the main body so as to produce a predetermined lighting effect of the seat cup holder.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
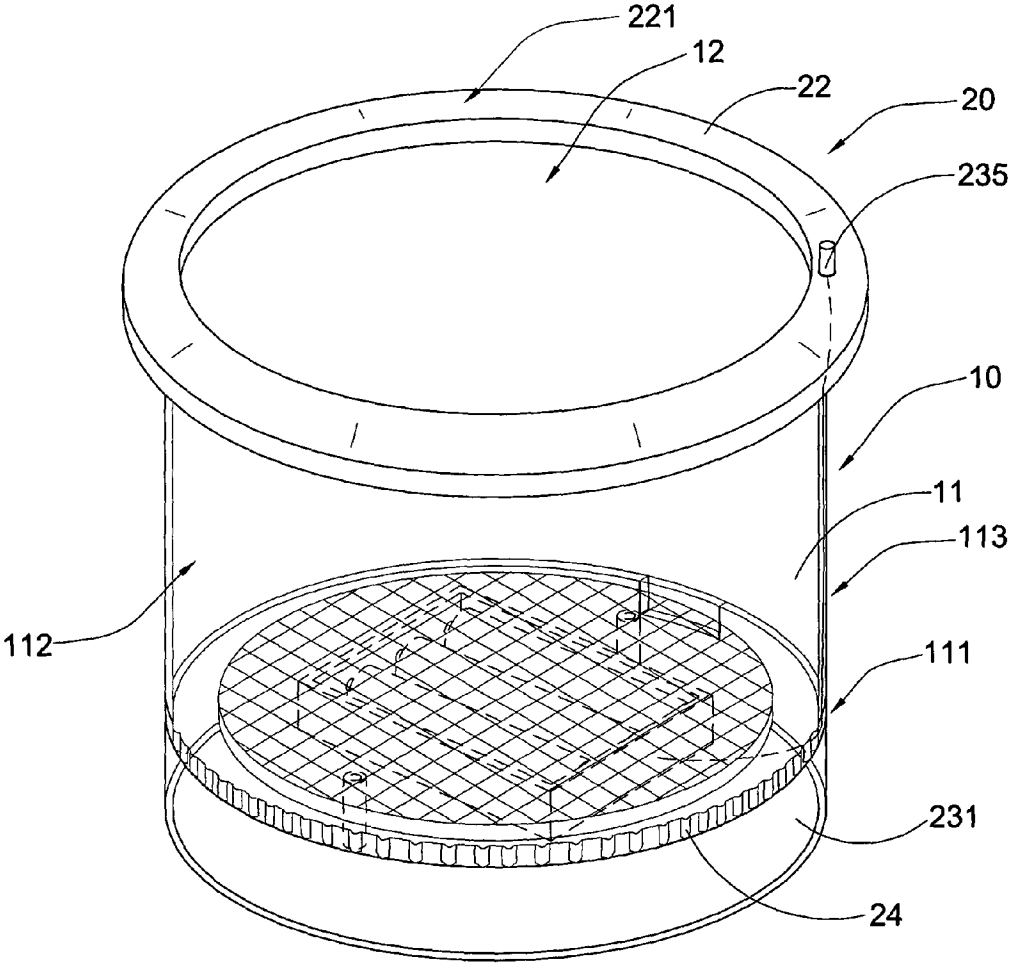
FIG. 1 is a perspective view of a seat cup holder according to a preferred embodiment of the present invention.

Referring to FIG. 1 to FIG. 4 of the drawings, a seat cup holder according to a preferred embodiment of the present invention is illustrated, in which the seat cup holder comprises a main body 10 and a rim night light arrangement 20.

The main body 10 comprises a holder element 11 and a holding rim 13. The holder element 11 has a predetermined height and cross sectional shape, and defines a receiving cavity 12 formed within the holder element 11.

The holding rim 13 is peripherally provided at a top edge portion of the holder element 11, and contains a receiving slot 131 formed along the holding rim 13.

The rim night light arrangement 20 comprises at least one illuminator 21 supported in the receiving slot 131 of the holding rim 13 for providing illumination, and a rim reflector 22. The rim reflector 22 is mounted on the holding rim 13 for peripherally enclosing the receiving slot 131 for reflecting illumination coming from the illuminator 21, wherein when the illuminator 21 is activated to generate illumination, the illumination is arranged to partially propagate toward the holder element 11, and partially propagate toward the rim reflector 22 which reflects the illumination to surrounding space of the main body 10 so as to produce a predetermined lighting effect of the seat cup holder of the present invention.

According to the preferred embodiment of the present invention, the holder element 11 of the main body 10 has a circular cross section and has a height which is sufficient to hold a cup of regular size (e.g. a 12 oz or 16 oz). The receiving cavity 12 is formed within the circular main body 10. Moreover, the holder element 11 is made of light admissible material, such as transparent material (example: plastic material) so as to allow the illumination from the rim night light arrangement to pass through. As a result, when the holder element 11 is subject to the illumination from a top portion thereof, a special lighting effect is created so as to allow the user to identify the location of the seat cup holder, or to allow the seat cup holder to form as a night light.

It is worth mentioning that, the holder element 11 can be embodied as having other cross sectional shapes so as to fit cups of different cross sectional shapes or to fit pre-existing cup holder equipped in a vehicle. For example, the holder element 11 may have a rectangular cross sectional shape or an elliptic cross sectional shape. The exact cross sectional shape of the holder element 11 depends on the actual manufacturing and marketing circumstances of a particular manufacturer.

Figure 5:
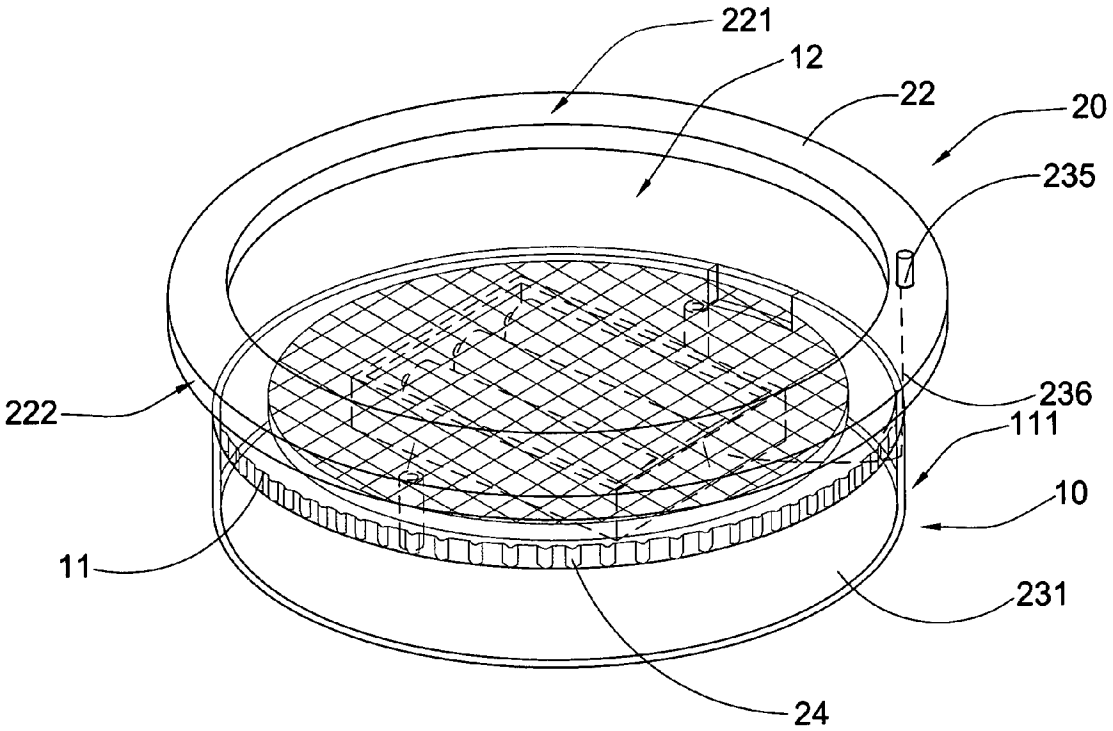
FIG. 5 is a slight alternative of a seat cup holder according to the above preferred embodiment of the present invention.

Furthermore, it is important to emphasize that by varying the height of the holder element 11, the holder element 11 can act as a substantially cup holder in the sense that it can be used to hold a cup of a substantial size and used in a different circumstances, such as a vehicle. In this case, the seat cup holder can be used primarily as a cup holder. Alternatively, as shown in FIG. 5 of the drawings, when the height of the holder element 11 is reduced, the entire main body 10 can be reduced to a compact size so as to primarily form a night light. However, it must be stressed that even when the height of the holder element 11 is reduced, it can still hold a cup.

The holding rim 13 of the main body 10 is peripherally formed along a top edge portion of the holder element 11, wherein the receiving slot 131 is indently formed along the holding rim 13 for receiving the illuminator 21 of the rim night light arrangement 20. The holding rim 13 is also made of light admissible material so that the illumination generated by the illuminator 21 can reach an exterior of the seat cup holder through the holder element 11.

Figure 2:
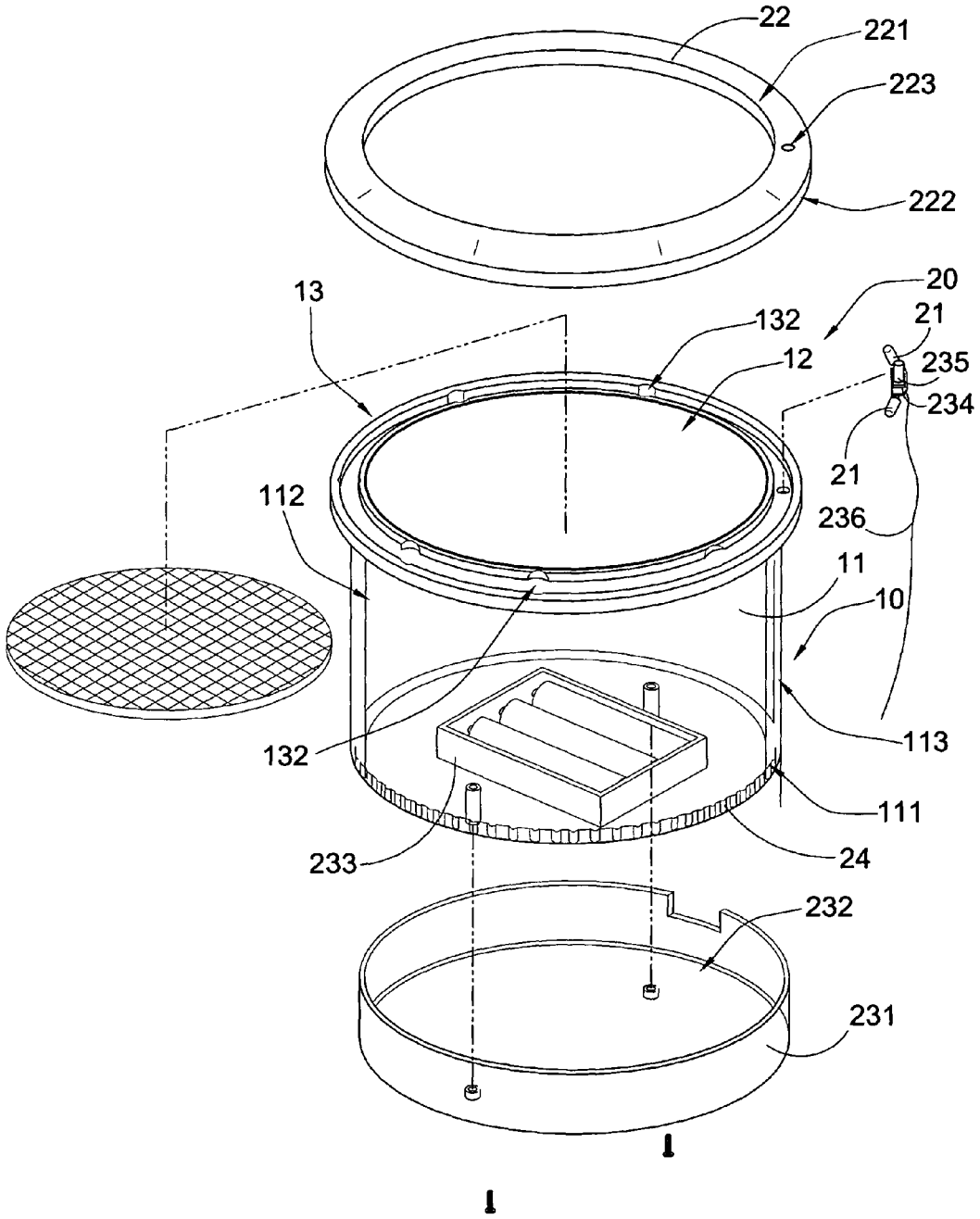
FIG. 2 is an exploded perspective view of the seat cup holder according to the above preferred embodiment of the present invention.

The holding rim 13 further has a plurality of light reflecting indentions 132 spacedly formed along the holding rim 13 for reflecting light generated by the illuminator 21. Accordingly, the rim night light arrangement 20 preferably comprises a plurality of illuminators 21 (as shown in FIG. 2 of the drawings) spacedly received in the holding rim 13 for generating illumination in two opposed directions of the holding rim 13 respectively, wherein the light reflecting indentions 132 are formed along the holding rim 13 so that the illumination generated by the illuminators 21 are outwardly reflected so that the illumination can reach different directions out of the holding rim 13. Thus, the light reflecting indentions 132 are arranged to alter a propagating direction of the illumination reaching thereon.

In order to receive the illuminators 21, a width of the receiving slot 131 is slightly greater than a width of each of the illuminators 21 so that the illuminators 21 can be completely received in the receiving slot 131 of the holding rim 13.

The illuminators 21 of the rim night light arrangement 20 are preferably LEDs arranged to generate illumination of a predetermined color, such as purple. On the other hand, the rim reflector 22 is mounted on top of the holding rim 13 for enclosing it. More specifically, the rim reflector 22 is elongated in shape and has a top reflection portion 221 and two side mounting portions 222 downwardly and peripherally extended from two sides of the top reflection portion 221 respectively so as to form a U-shaped cross section of the rim reflector 22. Furthermore, the rim reflector 22 is made of light reflective material, such as aluminum, so as to reflect the illumination generated by the illuminators 21.

Figure 3:
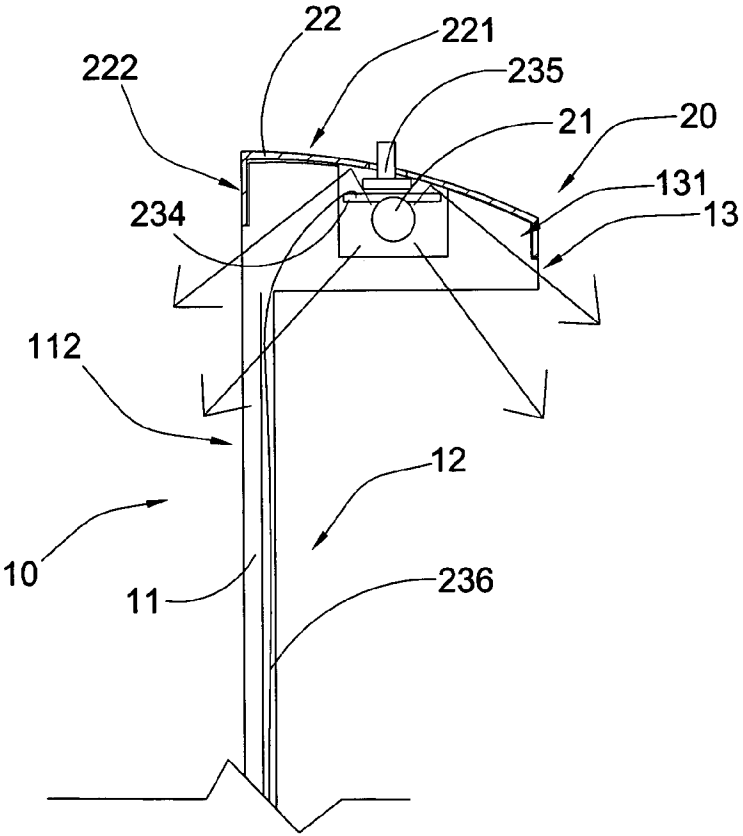
FIG. 3 is a sectional side view of the seat cup holder according to the above preferred embodiment of the present invention.
Figure 4:
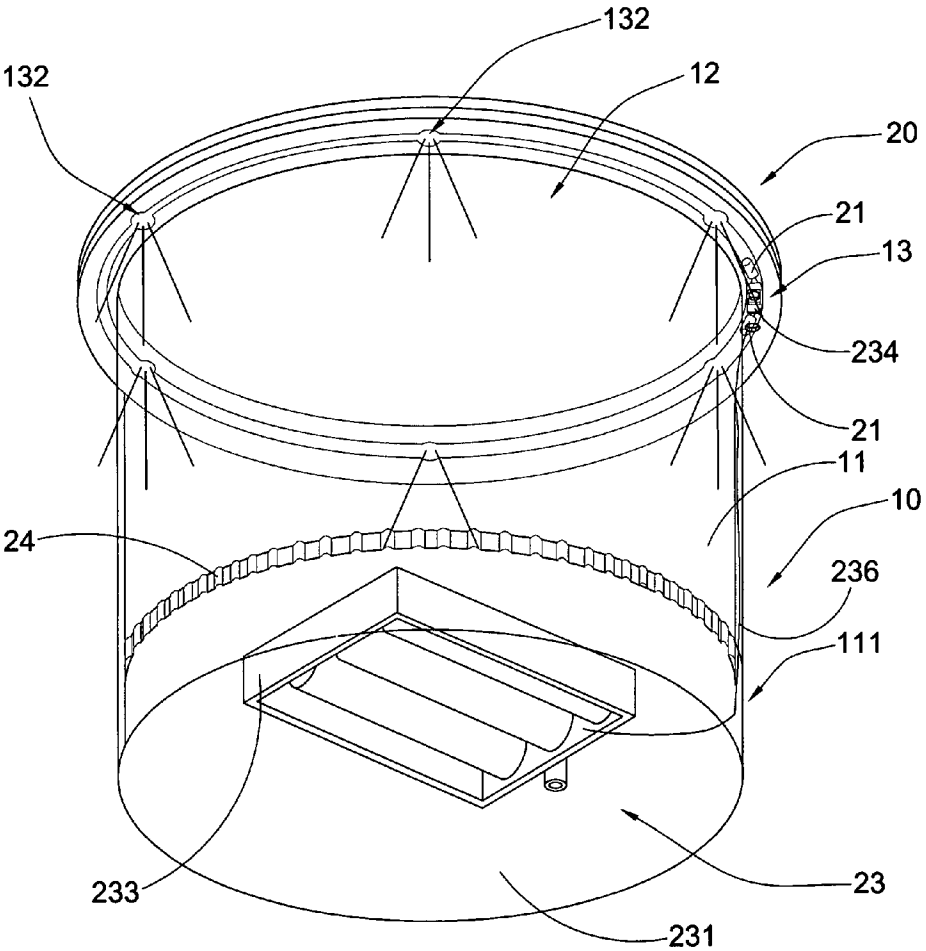
FIG. 4 is a bottom schematic view of the seat cup holder according to the above preferred embodiment of the present invention.

As shown in FIG. 3 of the drawings, when the illuminators 21 are activated to generate illumination, part of the illumination propagates along the holding rim 13, part of the illumination propagates toward the holding element 11, part of the illumination propagates outwardly from the holding rim 13, and part of the illumination propagates toward the rim reflector 22 because it is mounted on top of the holding rim 13. When the illumination propagating toward the rim reflector 22 reaches the rim reflector 22, the illumination is reflected back toward the holding rim 13 so as to strengthen the illumination propagating in other directions.

The rim night light arrangement 20 further comprises a power arrangement 23 mounted on the main body 10 and is electrically connected to the illuminators 21 for acquiring electricity from an external power source to provide power for the illuminators 21. According to the preferred embodiment, the power arrangement 23 comprises a power cover 231 detachably attached on a bottom edge portion 111 of the holder element 11 to define a power compartment 232 between the power cover 231 and the bottom edge portion 111 of the holder element 11, and a supporting tray 233 mounted in the power compartment 232 for detachably accommodating at least one battery therein. The supporting tray 233 is electrically connected to the illuminators 42 for providing power thereto. In the present invention, the supporting tray 233 is preferably arranged to detachably accommodate a plurality of batteries therein. These batteries may be rechargeable or disposable.

As shown in FIG. 2 of the drawings, the power arrangement 23 further comprises a control circuit 234 provided on the holding rim 13 and is electrically connected to the illuminators 21, and a plurality of electric wires 236 extended from the supporting tray to the control circuit 234 through a sidewall 112 of the holder element 11 for conducting electricity from the batteries to the control circuit 234. In other words, the holding element 11 further has a connection slot 113 indently extended along the sidewall 112 thereof, wherein the electric wires 236 are received in the connection slot 113 of the holder element 11 for conducting electricity. This arrangement also ensures that the electric wires 236 are well protected from external objects.

The power arrangement 23 further comprises an actuation switch 235 mounted on the control circuit 234 on the holding rim 13, and is extended to an exterior of the rim reflector 22 through a through switching hole 223 formed thereon, wherein the actuation switch 235 is extended from the control circuit 234 to expose to an exterior of the seat cup holder through the switching hole 223.

Figure 6:
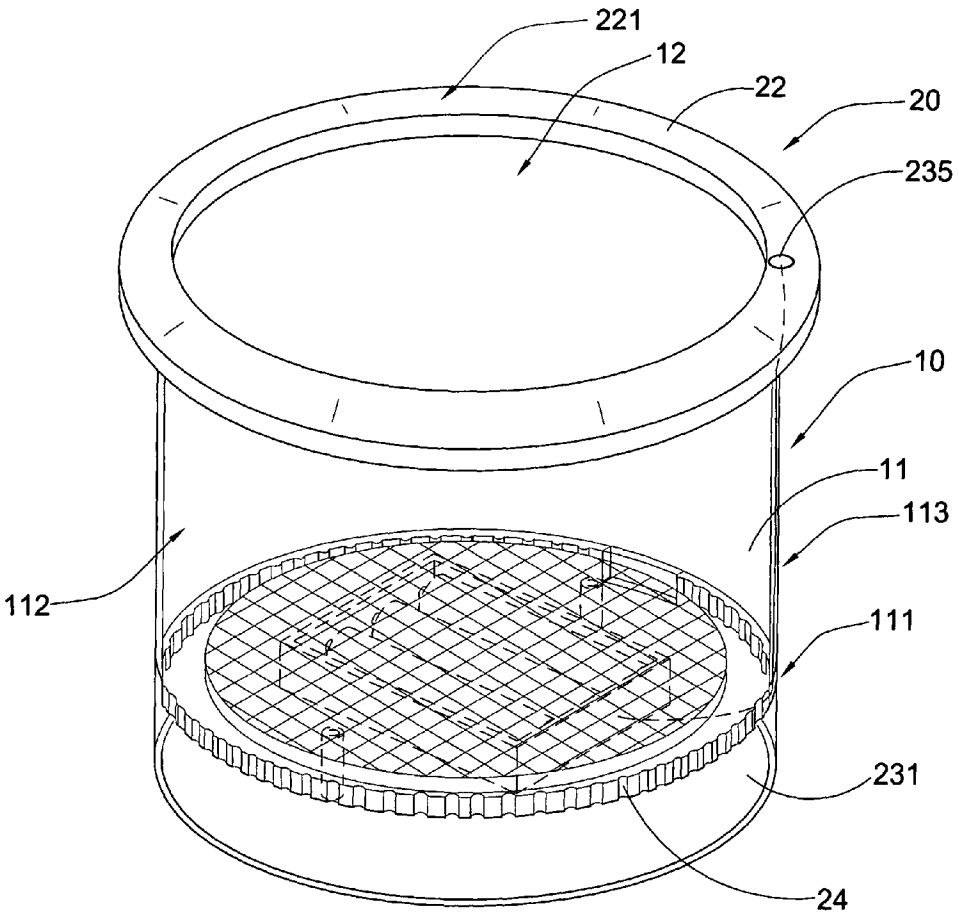
FIG. 6 is a slight alternative mode of the reflection rim according to the above preferred embodiment of the present invention.

When the actuation switch 235 is turned on, the illuminators 21 are activated to generate illumination. Since the holder element 11 is preferably made of transparent material or light admissible material, it is illuminated to identify the location of the cup disposed in the receiving cavity 12, or to act as a night light when the cup seat holder is operated during nighttime. In the preferred embodiment, the actuation switch 235 is extended from the rim reflector 22 at a predetermined elevation. However, as shown in FIG. 6 of the drawings, the actuation switch 235 can also be made to align with a top surface of the rim reflector 22 so as to minimize the protrusion formed by the actuation switch 235 with respect to the rim reflector 22.

In order to enhance the lighting effect of the seat cup holder, the rim night light arrangement 20 further comprises a reflection rim 24 peripherally formed along a bottom portion of the holder element 11 for further reflecting the illumination reaching the bottom portion of the holder element 11. The reflection rim 24 is arranged to reflect the illumination toward an upper portion of the holder element 11 and radially along the bottom portion of the holder element 11. In this preferred embodiment, the reflection rim 24 is formed on an outer surface of the holder element 11, yet it can also be formed on an inner surface of the holder element 11 (i.e. within the receiving cavity 12 as indicated in FIG. 6).

It is worth mentioning that the present invention, as an alternative, may also utilize Li-ion rechargeable battery as a power source for operating the illuminators 21. In such situation, the rechargeable battery may be directly attached to the bottom side of the element holder 11 to electrically connect to the control circuit 234. Thus, there is no need to have the power cover 231 and the supporting tray 233.

Figure 7:
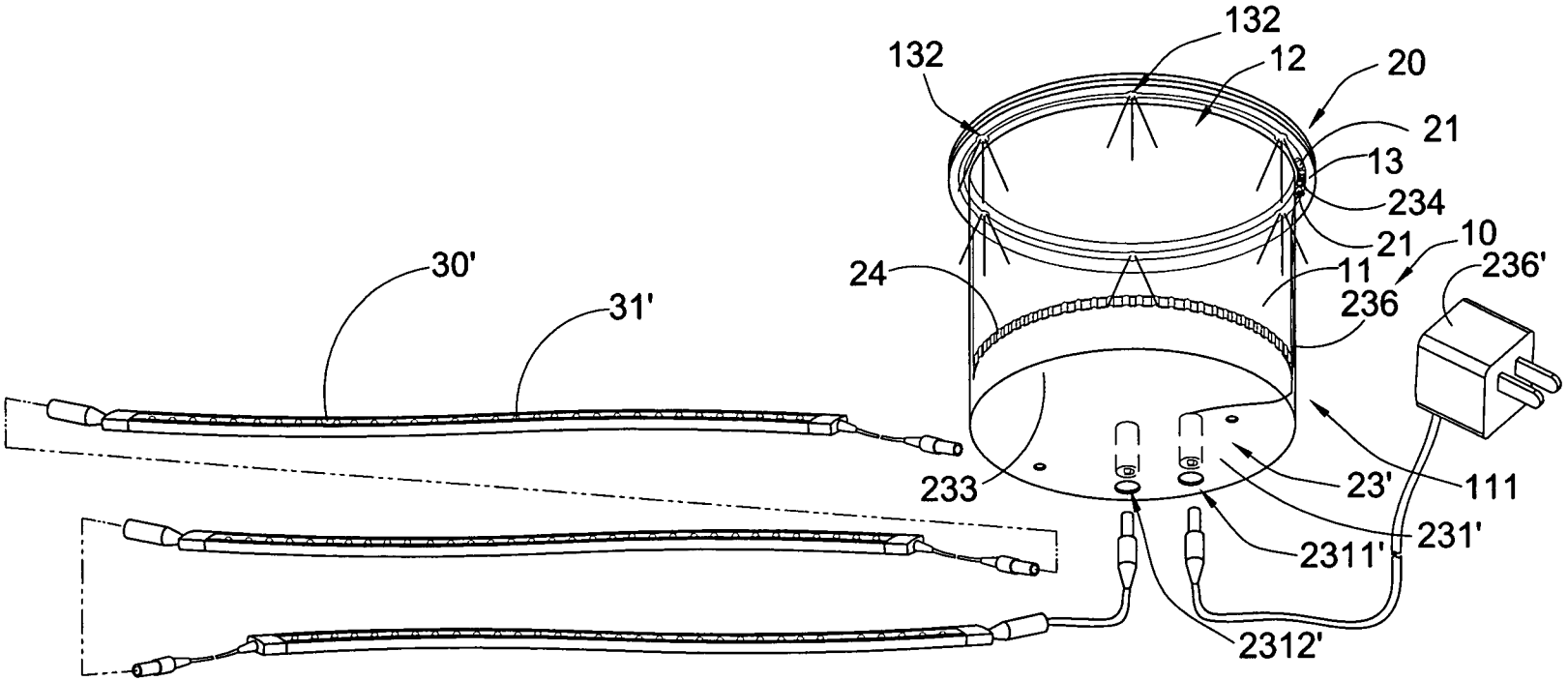
FIG. 7 is an alternative mode of the seat cup holder according to the above preferred embodiment of the present invention.

Referring to FIG. 7 of the drawings, an alternative mode of the seat cup holder according to the preferred embodiment of the present invention is illustrated. The first alternative mode is similar to the preferred embodiment, except the power arrangement 23'. According to the alternative mode, the power cover 231' of the power arrangement 23' has a power input port 2311' and a power output port 2312' formed on the power cover 231' and are electrically connected to the control circuit 234, whereas the battery is optional in this alternative mode but can pre-installed in the supporting tray 233. The battery is arranged to be electrically connected to an external AC power source through a predetermined adapter 236' and the power input port 2311'. When the battery is absent, the power input port 2311' and the power output port 2312' are directly connected to the control circuit 234.

Furthermore, the seat cup holder further comprises a plurality of auxiliary light strips 30' each having a plurality of illuminating units 31' arranged to electrically connect with the battery through the power output port 2312' for providing additional lighting at a distance from the seat cup holder. Note that the actuation switch 235 is arranged to control the operation of the illuminators 21 and the auxiliary light strips 30'. Thus, when the user actuates the actuation switch 235, the illuminators 21 and the auxiliary light strips 30' are turned on simultaneously. Similarly, they can also be turned off simultaneously.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A seat cup holder, comprising:

a main body, which comprises:

a holder element having a predetermined height and cross section shape, and defines a receiving cavity formed within said holder element; and a holding rim which is peripherally provided at a top edge portion of said holder element, and contains a receiving slot formed along said holding rim; and a rim night light arrangement, which comprises:

at least one illuminator supported in said receiving slot of said holding rim for providing illumination; and a rim reflector mounted on said holding rim for peripherally enclosing said receiving slot for reflecting illumination coming from said illuminator, wherein when said illuminator is activated to generate illumination, said illumination is arranged to partially propagate toward said holder element, and partially propagate toward said rim reflector which reflects said illumination to surrounding space of said main body so as to produce a predetermined lighting effect of said seat cup holder.

2. The seat cup holder, as recited in claim 1, wherein said holding rim of said main body is peripherally formed along a top edge portion of said holder element, wherein said receiving slot is indently formed along said holding rim for receiving said illuminator of said rim night light arrangement, wherein said holding rim is made of light admissible material so that said illumination generated by said illuminator is capable of reaching an exterior of said seat cup holder through said holder element.

3. The seat cup holder, as recited in claim 2, wherein said holding rim further has a plurality of light reflecting indentions spacedly formed along said holding rim for reflecting light generated by said illuminator.

4. The seat cup holder, as recited in claim 3, wherein said rim night light arrangement further comprises an illuminator received in said holding rim, wherein said illuminators are spacedly mounted in said holding rim for generating illumination in two opposite directions of said holding rim respectively, wherein said light reflecting indentions are arranged to alter a propagating direction of said illumination reaching thereon.

5. The seat cup holder, as recited in claim 4, wherein a width of said receiving slot is slightly greater than a width of each of said illuminators so that said illuminators are capable of being completely received in said receiving slot of said holding rim.

6. The seat cup holder, as recited in claim 1, wherein said rim reflector is mounted on top of said holding rim for enclosing thereon, wherein said rim reflector is elongated in shape and has a top reflection portion and two side mounting portions downwardly and peripherally extended from two sides of said top reflection portion respectively so as to form a U-shaped cross section of said rim reflector, wherein said rim reflector is made of light reflective material so as to reflect said illumination generated by said illuminator.

7. The seat cup holder, as recited in claim 5, wherein said rim reflector is mounted on top of said holding rim for enclosing thereon, wherein said rim reflector is elongated in shape and has a top reflection portion and two side mounting portions downwardly and peripherally extended from two sides of said top reflection portion respectively so as to form a U-shaped cross section of said rim reflector, wherein said rim reflector is made of light reflective material so as to reflect said illumination generated by said illuminators.

8. The seat cup holder, as recited in claim 1, wherein said rim night light arrangement further comprises a power arrangement mounted on said main body and is electrically connected to said illuminator for acquiring electricity from an external power source to provide power for said illuminator.

9. The seat cup holder, as recited in claim 6, wherein said rim night light arrangement further comprises a power arrangement mounted on said main body and is electrically connected to said illuminator for acquiring electricity from an external power source to provide power for said illuminator.

10. The seat cup holder, as recited in claim 7, wherein said rim night light arrangement further comprises a power arrangement mounted on said main body and is electrically connected to said illuminators for acquiring electricity from an external power source to provide power for said illuminators.

11. The seat cup holder, as recited in claim 8, wherein said power arrangement comprises a power cover detachably attached on a bottom edge portion of said holder element to define a power compartment between said power cover and said bottom edge portion of said holder element, and a supporting tray mounted in said power compartment for detachably accommodating at least one battery therein, wherein said supporting tray is electrically connected to said illuminator for providing power thereto.

12. The seat cup holder, as recited in claim 9, wherein said power arrangement comprises a power cover detachably attached on a bottom edge portion of said holder element to define a power compartment between said power cover and said bottom edge portion of said holder element, and a supporting tray mounted in said power compartment for detachably accommodating at least one battery therein, wherein said supporting tray is electrically connected to said illuminator for providing power thereto.

13. The seat cup holder, as recited in claim 10, wherein said power arrangement comprises a power cover detachably attached on a bottom edge portion of said holder element to define a power compartment between said power cover and said bottom edge portion of said holder element, and a supporting tray mounted in said power compartment for detachably accommodating at least one battery therein, wherein said supporting tray is electrically connected to said illuminators for providing power thereto.

14. The seat cup holder, as recited in claim 11, wherein said power arrangement further comprises a control circuit provided on said holding rim and is electrically connected to said illuminator, and a plurality of electric wires extended from said supporting tray to said control circuit through a sidewall of said holder element for conducting electricity from said battery to said control circuit.

15. The seat cup holder, as recited in claim 12, wherein said power arrangement further comprises a control circuit provided on said holding rim and is electrically connected to said illuminator, and a plurality of electric wires extended from said supporting tray to said control circuit through a sidewall of said holder element for conducting electricity from said battery to said control circuit.

16. The seat cup holder, as recited in claim 13, wherein said power arrangement further comprises a control circuit provided on said holding rim and is electrically connected to said illuminators, and a plurality of electric wires extended from said supporting tray to said control circuit through a sidewall of said holder element for conducting electricity from said battery to said control circuit.

17. The seat cup holder, as recited in claim 14, wherein said holding element further has a connection slot indently extended along said sidewall of said holding element, wherein said electric wires are received in said connection slot for conducting electricity so that said electric wires are well protected from ambient environment.

18. The seat cup holder, as recited in claim 15, wherein said holding element further has a connection slot indently extended along said sidewall of said holding element, wherein said electric wires are received in said connection slot for conducting electricity so that said electric wires are well protected from ambient environment.

19. The seat cup holder, as recited in claim 16, wherein said holding element further has a connection slot indently extended along said sidewall of said holding element, wherein said electric wires are received in said connection slot for conducting electricity so that said electric wires are well protected from ambient environment.

20. The seat cup holder, as recited in claim 17, wherein said power arrangement further comprises an actuation switch mounted on said control circuit on said holding rim, and is extended to an exterior of said rim reflector through a switching hole formed thereon, wherein said actuation switch is extended from said control circuit to expose to an exterior of said seat cup holder through said switching hole.

21. The seat cup holder, as recited in claim 18, wherein said power arrangement further comprises an actuation switch mounted on said control circuit on said holding rim, and is extended to an exterior of said rim reflector through a switching hole formed thereon, wherein said actuation switch is extended from said control circuit to expose to an exterior of said seat cup holder through said switching hole.

22. The seat cup holder, as recited in claim 19, wherein said power arrangement further comprises an actuation switch mounted on said control circuit on said holding rim, and is extended to an exterior of said rim reflector through a switching hole formed thereon, wherein said actuation switch is extended from said control circuit to expose to an exterior of said seat cup holder through said switching hole.

23. The seat cup holder, as recited in claim 7, wherein said holder element is made of light admissible material so as to allow said illumination from said rim night light arrangement to pass through, so that when said holder element is subject to said illumination from said illuminator, a special lighting effect is created at said holder element.

24. The seat cup holder, as recited in claim 16, wherein said holder element is made of light admissible material so as to allow said illumination from said rim night light arrangement to pass through, so that when said holder element is subject to said illumination from said illuminators, a special lighting effect is created at said holder element.

25. The seat cup holder, as recited in claim 22, wherein said holder element is made of light admissible material so as to allow said illumination from said rim night light arrangement to pass through, so that when said holder element is subject to said illumination from said illuminators, a special lighting effect is created at said holder element.

26. The seat cup holder, as recited in claim 4, wherein said rim night light arrangement further comprises a reflection rim peripherally formed along a bottom portion of the holder element for further reflecting the illumination reaching said bottom portion of said holder element.

27. The seat cup holder, as recited in claim 13, wherein said rim night light arrangement further comprises a reflection rim peripherally formed along a bottom portion of the holder element for further reflecting the illumination reaching said bottom portion of said holder element.

28. The seat cup holder, as recited in claim 25, wherein said rim night light arrangement further comprises a reflection rim peripherally formed along a bottom portion of the holder element for further reflecting the illumination reaching said bottom portion of said holder element.

29. The seat cup holder, as recited in claim 8, wherein said power arrangement comprises a power cover detachably attached on a bottom edge portion of said holder element to define a power compartment between said power cover and said bottom edge portion of said holder element, a control circuit provided on said holding rim and is electrically connected to said illuminator, a power input port provided on said power cover and electrically connected with said control circuit, a power output port provided on said power cover and electrically connected to said control circuit, and an adapter electrically connected between said power input port and an external AC power source for converting said AC power into DC power so as to provide power to said control circuit, wherein said seat cup holder further comprises at least one auxiliary light strip extended from said holder element, wherein said auxiliary light strip is electrically connected to said power output port, wherein said actuation switch is arranged to control an operation of said illuminator and said auxiliary light strip.

30. The seat cup holder, as recited in claim 9, wherein said power arrangement comprises a power cover detachably attached on a bottom edge portion of said holder element to define a power compartment between said power cover and said bottom edge portion of said holder element, a control circuit provided on said holding rim and is electrically connected to said illuminator, a power input port provided on said power cover and electrically connected with said control circuit, a power output port provided on said power cover and electrically connected to said control circuit, and an adapter electrically connected between said power input port and an external AC power source for converting said AC power into DC power so as to provide power to said control circuit, wherein said seat cup holder further comprises at least one auxiliary light strip extended from said holder element, wherein said auxiliary light strip is electrically connected to said power output port, wherein said actuation switch is arranged to control an operation of said illuminator and said auxiliary light strip.

31. The seat cup holder, as recited in claim 10, wherein said power arrangement comprises a power cover detachably attached on a bottom edge portion of said holder element to define a power compartment between said power cover and said bottom edge portion of said holder element, a control circuit provided on said holding rim and is electrically connected to said illuminators, a power input port provided on said power cover and electrically connected with said control circuit, a power output port provided on said power cover and electrically connected to said control circuit, and an adapter electrically connected between said power input port and an external AC power source for converting said AC power into DC power so as to provide power to said control circuit, wherein said seat cup holder further comprises at least one auxiliary light strip extended from said holder element, wherein said auxiliary light strip is electrically connected to said power output port, wherein said actuation switch is arranged to control an operation of said illuminators and said auxiliary light strip.

32. The seat cup holder, as recited in claim 31, wherein said rim night light arrangement further comprises a reflection rim peripherally formed along a bottom portion of the holder element for further reflecting the illumination reaching said bottom portion of said holder element.

* * * * *